US006029643A

United States Patent [19]

Golfieri

[11] Patent Number: 6,029,643

[45] Date of Patent: Feb. 29, 2000

[54] BOW SIGHTING UNIT AND STAND

[76] Inventor: David A. Golfieri, R.D. 3 Box 470A, Watsontown, Pa. 17777

[21] Appl. No.: 09/005,347

[22] Filed: Jan. 9, 1998

[51] Int. Cl.[7] ..... F41B 5/14

[52] U.S. Cl. ..... 124/1

[58] Field of Search ..... 124/1, 23.1, 86; 248/560, 582, 592, 595, 596, 598

[56] References Cited

U.S. PATENT DOCUMENTS

| | | | |
|---|---|---|---|
| 1,087,807 | 2/1914 | Miller et al. | 248/598 X |
| 2,548,328 | 4/1951 | Thayer | 248/596 X |
| 3,532,309 | 10/1970 | Reddick | 248/598 X |
| 3,924,083 | 12/1975 | Hagey | 248/596 |
| 4,048,726 | 9/1977 | LeFebvre . | |
| 4,993,397 | 2/1991 | Cryar et al. . | |
| 5,121,736 | 6/1992 | Hawk | 124/86 |
| 5,509,400 | 4/1996 | Chalin | 124/86 |
| 5,619,981 | 4/1997 | Breedlove . | |
| 5,628,300 | 5/1997 | Wallendorff . | |
| 5,630,568 | 5/1997 | Lubrecht . | |
| 5,806,508 | 9/1998 | Stempien et al. | 124/86 |

*Primary Examiner*—John A. Ricci
*Attorney, Agent, or Firm*—John J. Elnitski, Jr.

[57] ABSTRACT

Disclosed is a sighting unit and stand for an archery bow. The sighting unit and stand are used for sighting-in an archery bow having a sighting device. Techniques involved in properly firing a bow can be practiced and perfected utilizing the present invention, while allowing the archer to execute the "complete" shot. The present invention allows for the stabilization of the bow for the perfect sight adjustment and shot. The sighting unit includes a mounting post, a recoil lever rotatably fixed to the mounting post, and an attachment rod fixed to the recoil lever for mounting the bow. The attachment rod includes a tube and an attachment stud. The attachment stud includes a threaded stud on one end and a threaded hole on the other end. A bolt attaches the attachment stud to the tube by threading the bolt into the threaded hole of the attachment stud. The sighting unit further includes a recoil spring between the mounting post and the recoil lever.

23 Claims, 6 Drawing Sheets

BOW SIGHTING UNIT AND STAND

BACKGROUND

The accuracy of any archery bow is determined by the mechanical components of the bow, the method of sighting-in the bow and the ability of the individual firing the bow. There are nine main factors involved for consistent shooting accuracy of a bow. These nine factors are stance; breathing; bow arm extension; bow grip; drawing of the bowstring; anchor point; aiming; release; and follow-through.

A bow can be shot instinctively or with the aid of mechanical sights mounted to the bow's riser. A bow utilizing a sighting device requires adjustments to one or several sight pins for perfect arrow placement at specific distances to a target. Because bows are designed to be fired free-handly, the ability to stabilize a bow and repeat perfect sequential firing for sighting-in purposes is extremely difficult due to human error. For absolute accuracy, the following criteria must be attained to sight-in a bow free-handly. The archer must repetably execute perfect form, release and follow-through. The archer must commit to practice hundreds of times in order to duplicate the positive muscle reflex and stimumli for optimum control of the bow. Currently, available devices to mechanically hold and fire a bow remove all human involvement to execute the shot. These devices do not compensate for the intricacies of each archer's individual shooting style by allowing the complete execution of each shot. Due to the unpopularity of these current devices among archers, a void in the market exists for equipment to sight-in a bow.

It is an object of the present invention to provide a device for sighting-in an archery bow, while allowing the archer to execute the psychomotor and locomotor shooting skills to simulate shooting the bow free-handed.

It is also an object of the present invention to provide such a device that is easy to use, is simple to manufacture, is stable enough to satisfy the archer, and allows the archer to execute and practice critical shooting skills.

SUMMARY OF THE INVENTION

The present invention is a sighting unit and stand for an archery bow. The sighting unit includes a mounting post, a recoil lever rotatably fixed to the mounting post, and an attachment rod fixed to the recoil lever for mounting the bow. The attachment rod includes a tube and an attachment stud. The attachment stud includes a threaded stud on one end and a threaded hole on the other end. A bolt attachs the attachment stud to the tube by threading the bolt into said threaded hole of the attachment stud. The sighting unit further includes a recoil spring between the mounting post and the recoil lever.

The mounting post attaches to a stand for attaching the mounting post in a stablized position. The stand includes a platform and a support post extending from the platform for attaching the mounting post. The stand includes two support arms fixed between the support post and the platform. The platform includes two legs, three cross members and a standing plate. The mounting post and support post include a series of adjustment holes for adjusting the sighting unit height.

DETAILED DESCRIPTION

The present invention provides a bow sighting unit and stand for sighting-in an archery bow having a sighting device. The above-mentioned nine factors can be practiced and perfected utilizing the present invention, while allowing the archer to execute the "complete" shot. The present invention allows for the stabilization of the bow for the perfect sight adjustment and shot.

Figure 1:
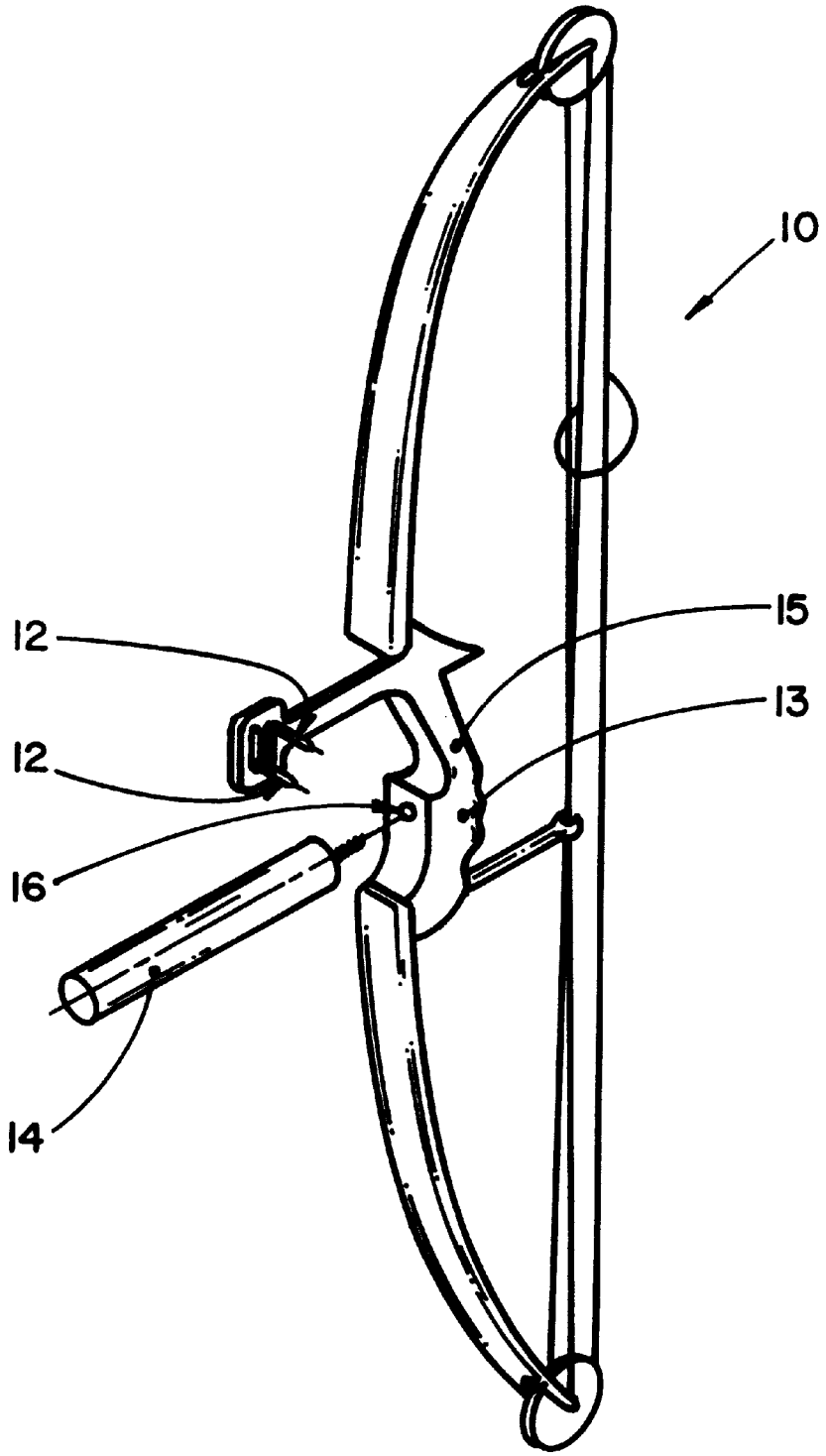
FIG. 1 is a perspective view of an archery bow used with the present invention.
Figure 2:
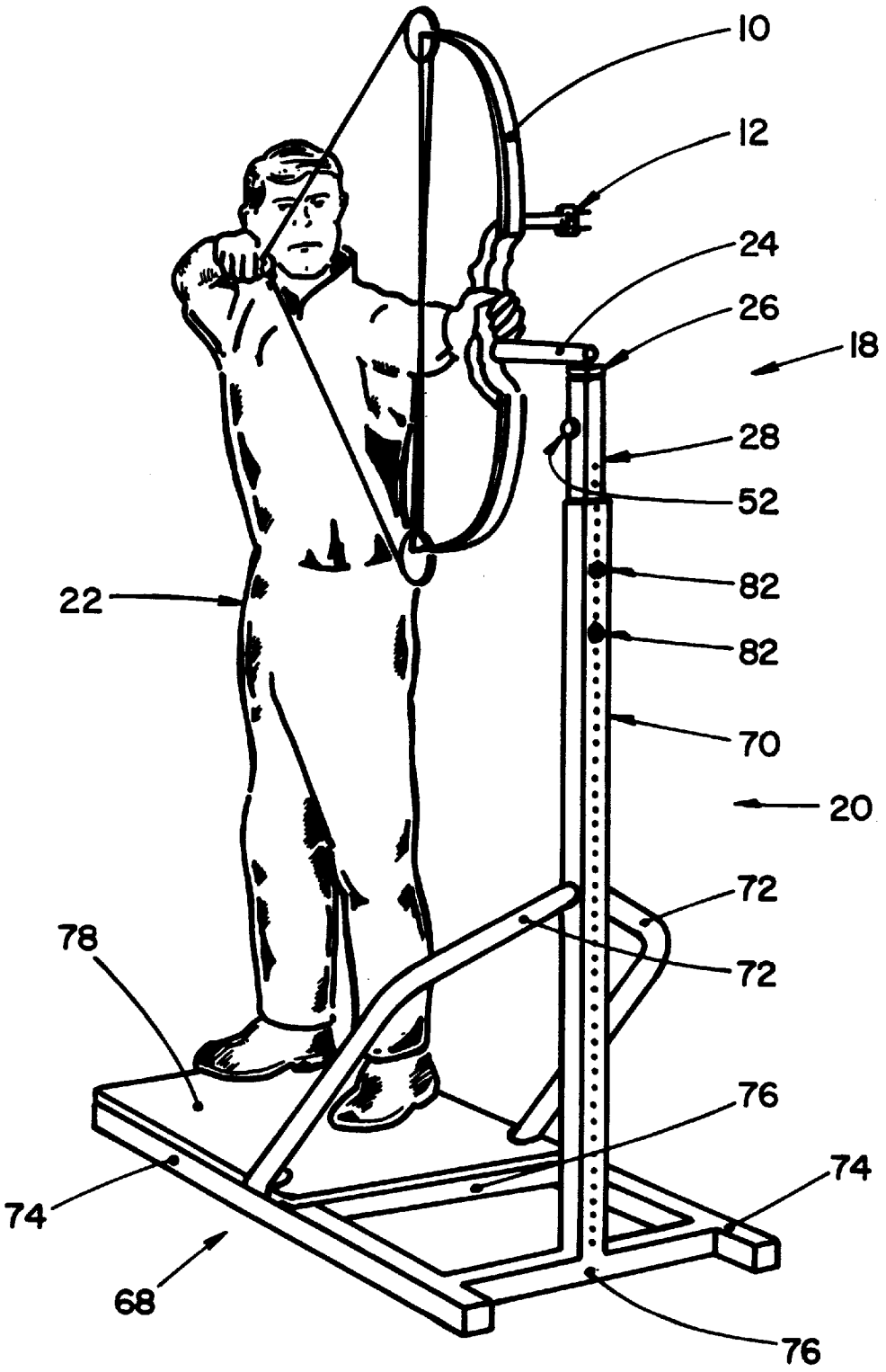
FIG. 2 is a perspective view of a sighting unit and stand according to the present invention.
Figure 3:
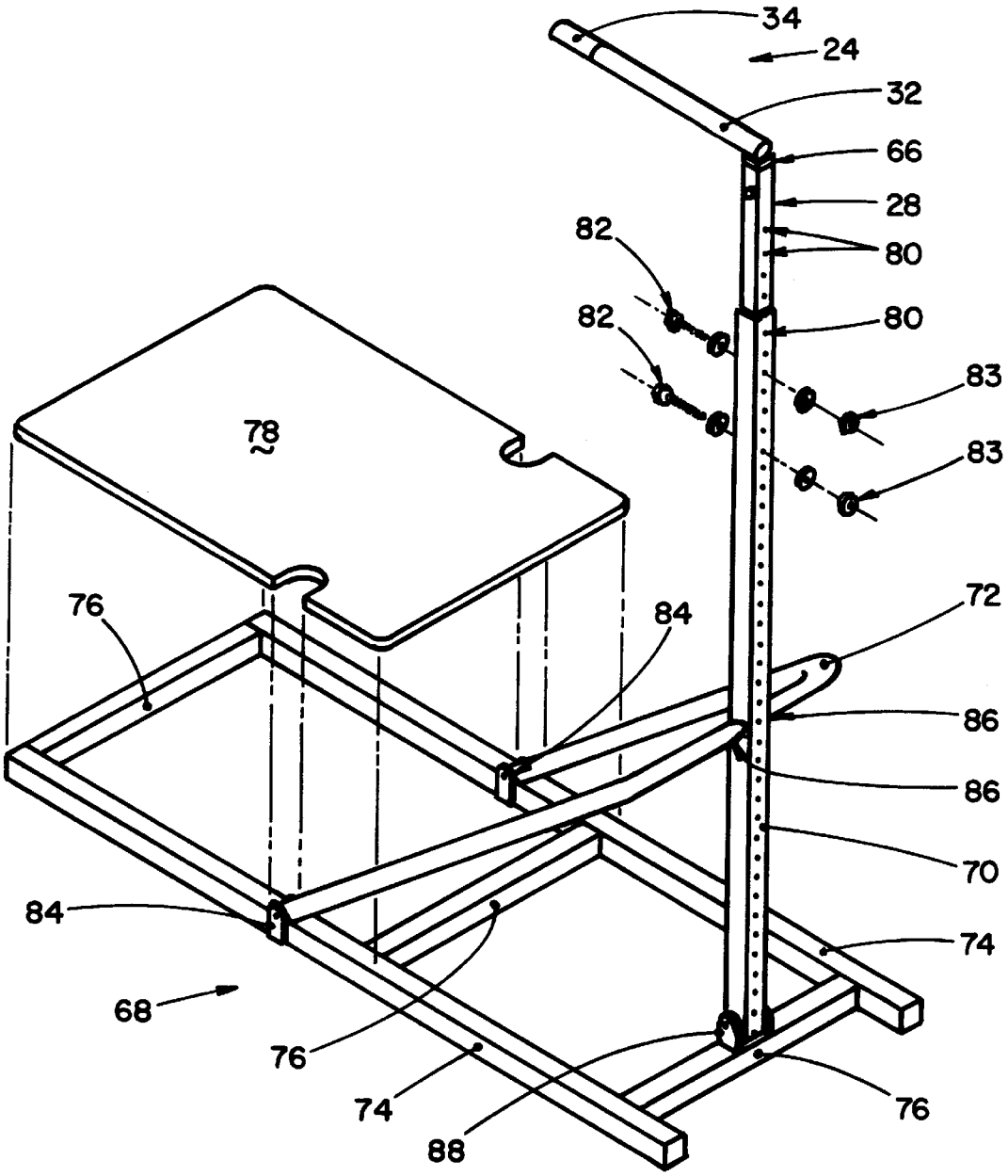
FIG. 3 is a perspective exploded view of the sighting unit and stand shown in FIG. 2.

The sighting unit is particularly directed to archery bows which employ a counter weight or stabilizer to balance a bow. FIG. 1 illustrates a typical compound bow 10 with sight pins 12 and a stabilizer 14. The sight pins 12 are shown as an example of a sighting device, but could be replaced by any type of sighting device used with an archery bow. The stabilizer 14 screws into a threaded hole 16 in the riser 13 below the grip 15 of the bow 10. It is envisioned that any archery bow not having the stabilizer hole 16 could be modified to include such a hole. FIG. 2 shows the sighting unit 18 and stand 20 with the bow 10 attached and an archer 22 operating the bow 10. The bow 10 attaches to the sighting unit 18 with an attachment rod 24. The attachment rod 24 screws into the stabilizer hole 16 in place of the stabilizer 14. The attachment rod 24 is fixed to a recoil lever 26. The recoil lever 26 is rotatably fixed inside a mounting post 28. The mounting post 28 is shown fixed to the stand 20. The bow sighting unit 18 and stand 20 provide a means of fixing the bow 10 in one position, whereby the archer can adjust the sighting device after shooting arrows into a target.

Figure 4:
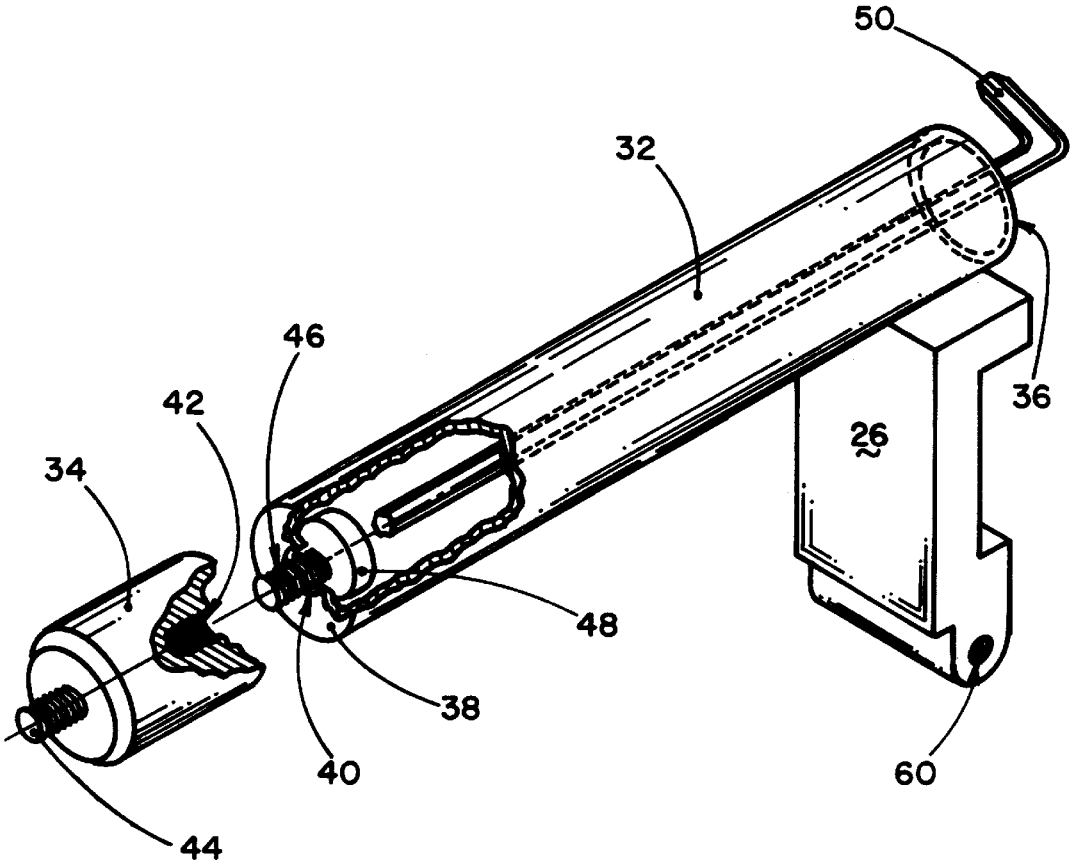
FIG. 4 is a perspective exploded and cutaway view of an attachment rod and recoil lever of the sighting unit shown in FIG. 2.
Figure 5:
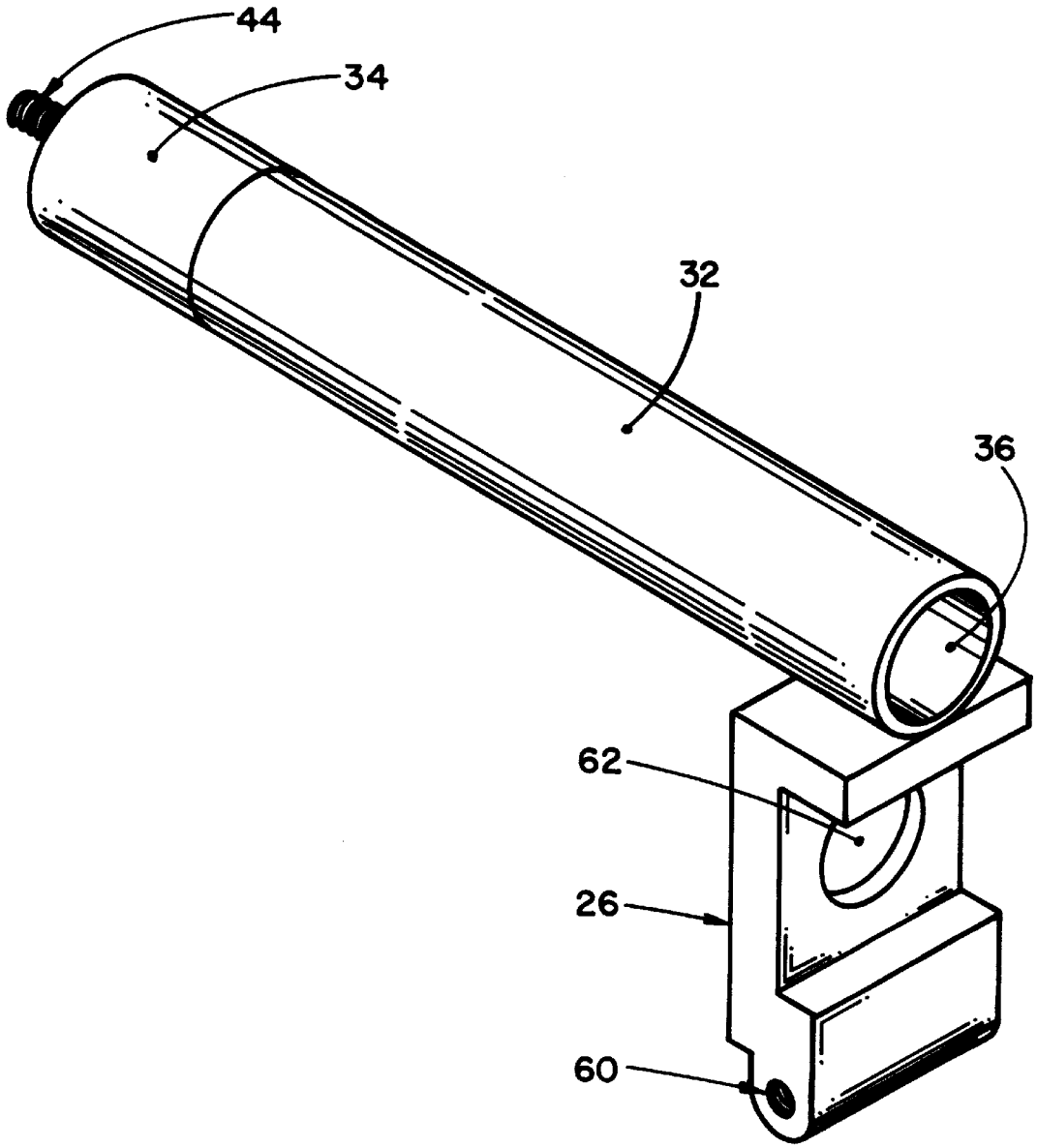
FIG. 5 is a perspective view of the attachment rod and recoil lever of the sighting unit shown in FIG. 4.
Figure 6:
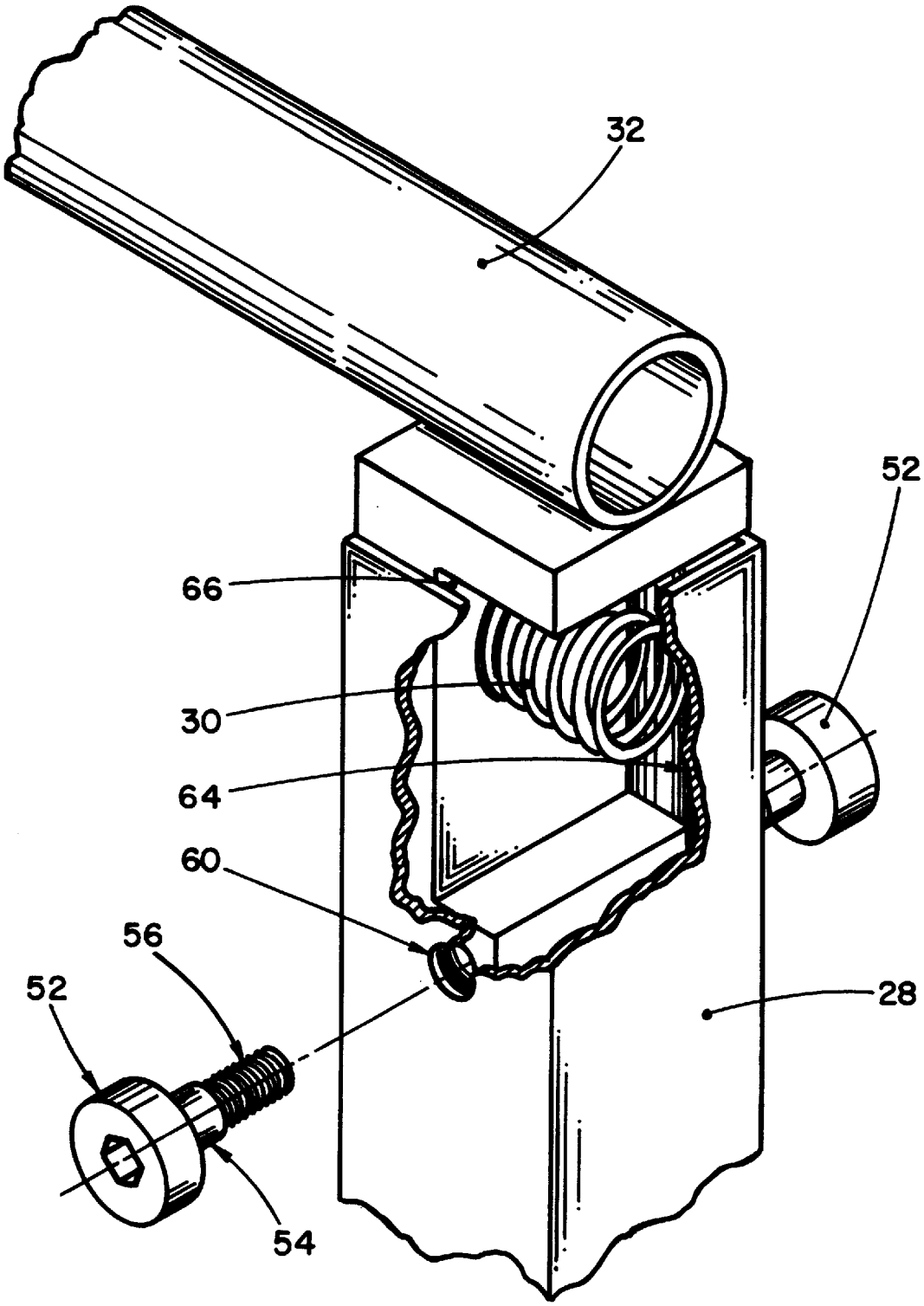
FIG. 6 is a perspective exploded and cutaway view of the recoil lever and a mounting post of sighting unit shown in FIG. 2.

FIGS. 2–6 illustrate the sighting unit 18 and stand 20. The sighting unit 18 includes the attachment rod 24, the recoil lever 26, a recoil spring 30 and the mounting post 28. The attachment rod 24 is fixed to the recoil lever 26. In the case of a steel prototype that was manufactured, the attachment rod 24 was welded to the recoil lever 26. The attachment rod 24 includes a hollow tube 32 and an attachment stud 34, as shown in FIGS. 4–5. For the prototype, the hollow tube 32 was the component welded to the recoil lever 26. The hollow tube 32 includes an open end 36 and a closed end 38. The closed end 38 includes a bolt hole 40. The attachment stud 34 includes a threaded hole 42 on one end and threaded stud 44 on the other end. The threaded stud 44 is sized to screw into the stabilizer hole 16 of the bow 10. The attachment stud hole 42 receives a bolt 46 which extends from the bolt hole 40 of the tube 32. The bolt 46 secures the attachment stud 34 as well as the bow 10 to the tube 32. For the prototype, the bolt 46 included a hex socket head 48 (socket not shown), along with a hex key 50 which was longer than the tube 32.

The recoil lever 26 is rotatably fixed inside the mounting post 28. In the case of the prototype, two lever bolts 52 having a shoulder 54 and a threaded section 56 were used. Each lever bolt 52 inserts into one of two lever bolt holes 58 in the mounting post 28 and threads into threaded holes 60 of the recoil lever 26. The lever bolts 52 secured the recoil lever 26 in the mounting post 28, so that the lever 26 cannot move up and down, nor twist in the mounting post 28. The shoulder 54 of the lever bolt 52 is sized so that the lever bolt 52 and therefore the recoil lever 26 can rotate about center axis of the lever bolt holes 58. The recoil lever 26 includes a recess 62 for receiving the recoil spring 30. The recoil spring 30 is positioned between the recoil lever recess 62 and the forward inside surface 64 of the mounting post 28. The recoil spring 30 is chosen to be strong enough to rigidly hold the recoil lever 26 steady and therefore the bow 10 in place until the bow 10 is fired. Once the bow 10 is fired, the recoil spring 30 absorbs some of the bow recoil to avoid shocking the bow 10 due to the force of the recoil. Note space 66 between the recoil lever 26 and the mounting post 28. The space 66 allows the recoil lever 26 to rotate forward and downward with in the mounting post 28. This movement of the recoil lever 26 is necessary due to the natural recoil of the bow 10 when fired. The movement of the recoil lever 26 allows the bow 10 to naturally move forward and downward after firing, thereby allowing the archer to follow-through with the shot. The mounting post 28 can vary in length and be attached to any solid object which will support the sighting unit 28 and the bow 10 rigidly. In the case of the prototype, the sighting unit 18 was attached to the stand 20.

The stand includes a platform 68, a support post 70 and support arms 72. The platform 68 of the prototype includes two legs 74 connected by three cross-members 76. A standing plate 78 mounts to the legs 74 for the archer to stand on while firing the bow 10. The platform 68 of the stand 20 serves two purposes. The first purpose is to provide a portable unit to support the sighting unit 18. The second purpose is to provide a place for the archer to stand, whereby the weight of the archer weights down the sighting unit 18 so it does not move. The legs 74 include leveling feet (not shown) for adjusting the stand on uneven terrain to provide maximum stability. The support post 70 extends upward from the platform 68, ahead of where the archer stands. In the case of the prototype, the support post 70 and mounting post 28 were manufactured from square steel stock. The mounting post 28 was sized smaller than the support post 70 so that mounting post 28 fits into the support post 70. Each post 28 and 70 includes a series of adjustment holes 80, so that the height of the sighting unit 18 is adjustable. Post bolts 82 and nuts 83 secure the mounting post 28 to the support post 70. The support arms 72 connect to the platform 68 at points 84 and connect to the support post 70 at points 86. The support arms 72 support the support post 70 to prevent bending or twisting of the support post 70. For the prototype, the support arms 72 were welded at points 84 and 86. It is envisioned that the support post 70 could be rotatably fixed at point 88. It is also envisioned that the supports arms 72 could be rotatably fixed at either points 84 or points 86, whereby the points not chosen to be rotatably fixed would be detachable (not shown). This would allow the stand 20 to be foldable for storage. There are various other devices and techniques known in the art which could be used to make the stand 20 foldable. Another envisioned embodiment (not shown) would include extendible and retractable support arms and the support post 70 rotatably fixed at the point 88. This would allow angling of the support post 70 and the sighting unit 20 to compensate for the stand being on an unlevel surface (not shown).

While different embodiments of the invention have been described in detail herein, it will be appreciated by those skilled in the art that various modifications and alternatives to the embodiment could be developed in light of the overall teachings of the disclosure. Accordingly, the particular arrangements are illustrative only and are not limiting as to the scope of the invention which is to be given the full breadth of the appended claims and any and all equivalents thereof.

I claim:

1. A sighting unit for an archery bow comprising:

a mounting post;

a recoil lever rotatably fixed to said mounting post configured for absorbing the recoil of said bow during firing; and an attachment rod having a first end fixed to said recoil lever and a second end configured for mounting to a riser of said bow.

2. The sighting unit of claim 1, wherein said attachment rod includes a tube and an attachment stud.

3. The sighting unit of claim 2, wherein said attachment stud includes a threaded stud on one end and a threaded hole on the other end.

4. The sighting unit of claim 3, further including a bolt to attach said attachment stud to said tube by threading said bolt into said threaded hole of the attachment stud.

5. The sighting unit of claim 1, further including a recoil spring between said mounting post and said recoil lever.

6. The sighting unit of claim 5, wherein said recoil lever further includes a recess to receive said recoil spring.

7. The sighting unit of claim 6, wherein said recoil lever is partially inside of said mounting post, wherein said recess is inside of said mounting post and wherein said recoil spring is between said recess and an inside surface of said mounting post.

8. The sighting unit of claim 7, further including at least one lever bolt to rotatably fix the recoil lever to said mounting post, at least one hole in said mounting post to receive said lever bolt and at least one threaded hole in said recoil lever to receive said lever bolt.

9. The sighting unit of claim 1, further including a stand for attaching said mounting post in a stablized position.

10. The sighting unit of claim 9, wherein said stand includes a platform and a support post extending from said platform for attaching said mounting post.

11. The sighting unit of claim 10, further including at least one support arm fixed between said support post and said platform.

12. The sighting unit of claim 11, wherein said platform includes at least one leg, at least one cross member and a standing plate.

13. The sighting unit of claim 12, wherein said mounting post attaches to said support post so that the height of the sighting unit is adjustable.

14. The sighting unit of claim 13, wherein said mounting post and support post include a series of adjustment holes for adjusting the sighting unit height.

15. The sighting unit of claim 11, wherein said support post rotates about a point where said support post attaches to said platform and wherein support arm length is adjustable.

16. The sighting unit of claim 9, wherein said attachment rod includes a threaded stud on said second end for mounting to said riser and wherein said riser includes a threaded hole for receiving said threaded stud.

17. The sighting unit of claim 9, wherein said recoil lever includes a recoil spring to absorb said recoil.

18. The sighting unit of claim 17, wherein said recoil lever is partially inside of said mounting post and wherein said recoil spring is between said recoil lever and an inside surface of said mounting post.

19. The sighting unit of claim 9, wherein said mounting post attaches to said support post so that the height of the sighting unit is adjustable.

20. The sighting unit of claim 19, wherein said mounting post and support post include a series of adjustment holes for adjusting the sighting unit height.

21. The sighting unit of claim 9, wherein said support post rotates about a point where said support post attaches to said platform and wherein support arm length is adjustable.

22. The sighting unit of claim 1, wherein said attachment rod includes a threaded stud on said second end for mounting to said riser and wherein said riser includes a threaded hole for receiving said threaded stud.

23. The sighting unit of claim 1, wherein said recoil lever includes a recoil spring to absorb said recoil.

* * * * *